US007470132B2

(12) United States Patent
Perrin et al.

(10) Patent No.: US 7,470,132 B2
(45) Date of Patent: Dec. 30, 2008

(54) INERTIALLY LOCKING SELF-CENTERING CONNECTOR

(75) Inventors: Philippe Perrin, Le Perray En Yvelines (FR); Joël Lacrouts-Cazenave, Maurepas (FR)

(73) Assignee: Societe Compagnie Deutsch, Rueil-Malmaison (FR)

( * ) Notice: Subject to any disclaimer, the term of this patent is extended or adjusted under 35 U.S.C. 154(b) by 2 days.

(21) Appl. No.: 11/596,843

(22) PCT Filed: May 17, 2005

(86) PCT No.: PCT/FR2005/001235

§ 371 (c)(1), (2), (4) Date: Jan. 16, 2007

(87) PCT Pub. No.: WO2005/124937

PCT Pub. Date: Dec. 29, 2005

(65) Prior Publication Data

US 2007/0243737 A1 Oct. 18, 2007

(30) Foreign Application Priority Data

May 19, 2004 (FR) ..... 04 05494

(51) Int. Cl.
*H01R 29/00* (2006.01)

(52) U.S. Cl. ..... 439/188; 439/378; 439/248; 439/358

(58) Field of Classification Search ..... 439/188, 439/354, 358, 378, 376, 248; 200/51.1
See application file for complete search history.

(56) References Cited

U.S. PATENT DOCUMENTS

| | | | | |
|---|---|---|---|---|
| 5,061,197 | A | 10/1991 | Kuzuno et al. | 439/262 |
| 5,131,864 | A * | 7/1992 | Van Zeelst et al. | 439/460 |
| 6,488,520 | B1 * | 12/2002 | Hayes et al. | 439/188 |
| 6,547,577 | B2 * | 4/2003 | Fujita et al. | 439/188 |
| 6,641,424 | B1 * | 11/2003 | Hanak et al. | 439/352 |
| 7,275,946 | B2 * | 10/2007 | Ohtaka et al. | 439/188 |
| 2002/0016102 | A1 * | 2/2002 | Saba | 439/188 |
| 2003/0228782 | A1 * | 12/2003 | Nishida et al. | 439/188 |
| 2004/0005806 | A1 * | 1/2004 | Annecke | 439/358 |

FOREIGN PATENT DOCUMENTS

| | | |
|---|---|---|
| DE | 100 32 234 | 1/2002 |
| EP | 1087470 | 3/2001 |
| EP | 1339138 | 8/2003 |

* cited by examiner

*Primary Examiner*—Hien Vu
(74) *Attorney, Agent, or Firm*—Young & Thompson

(57) ABSTRACT

A mobile contact carrier (2) and a lock (3) includes two connecting elements for securing the simultaneous insertion thereof into a fixed contact carrier (1) and disconnecting elements used at the end of a connecting phase for inertially locking a connector.

7 Claims, 8 Drawing Sheets

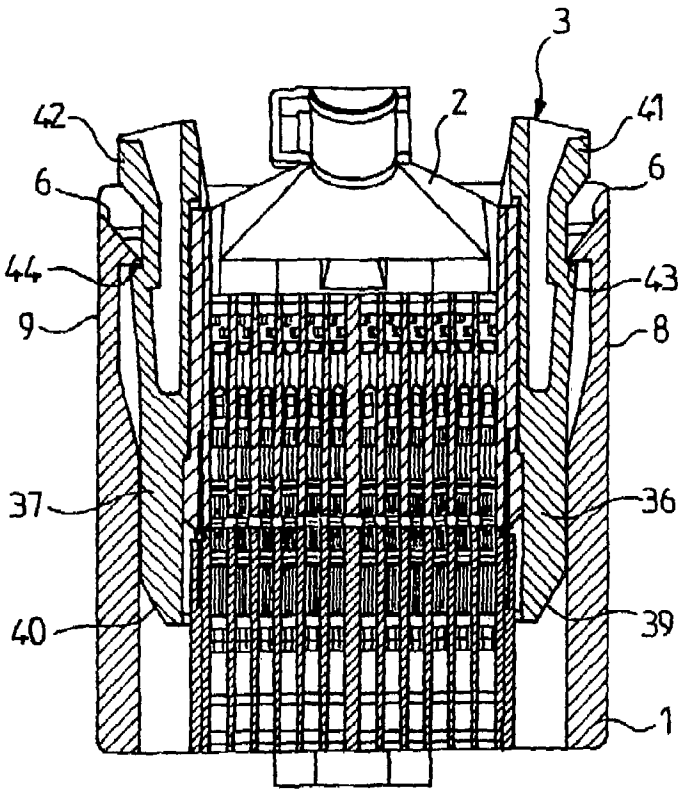
FIG.2 A-A
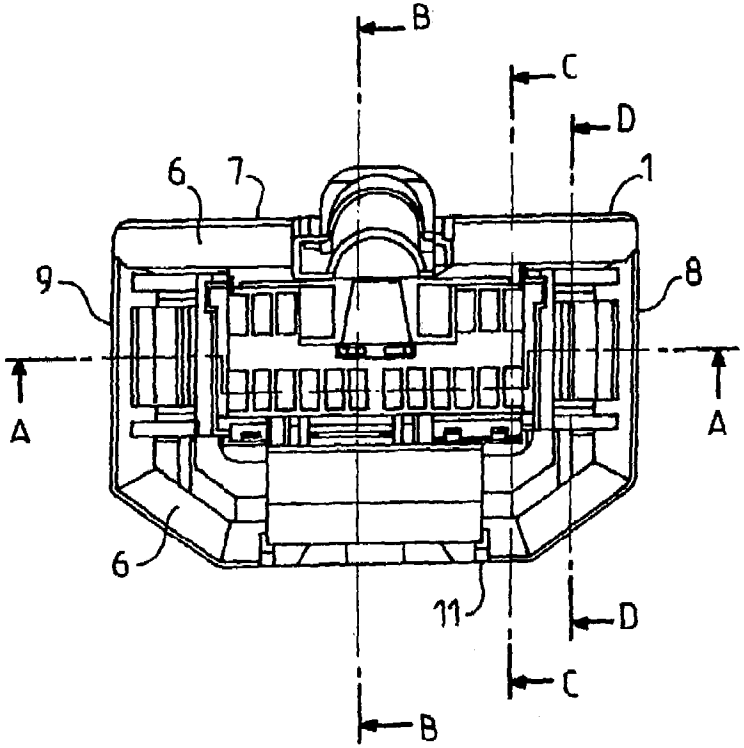
FIG.1

INERTIALLY LOCKING SELF-CENTERING CONNECTOR

BACKGROUND OF THE INVENTION

The invention relates to a self-centering, inertial-locking connector.

Such a connector is provided to ensure the connection between two conductor bundles or the connection of a bundle to a printed circuit.

A first technical problem to be solved is that of the correct installation of the movable portion of the connector relative to the stationary portion.

A second technical problem posed by these connectors is that of the surface quality of the electric contact studs, whereas in each of the portions of the connector, these surfaces are in the open air before the connection.

A third technical problem is linked to the uniform polarization of the contacts of the movable portion of the connector by means of a shunt that should be removed at the time of connection.

SUMMARY OF THE INVENTION

One object of the invention is to propose a connector that can solve these problems simply and effectively. Another object of the invention is to propose a connector that ensures locking at the position of the connection in a virtually automatic manner at the end of the connection operation.

This invention has as its object a self-centering, inertial-locking connector, comprising a stationary contact terminal, a movable contact terminal and a lock, characterized in that the movable contact terminal and the lock comprise means for engagement for ensuring the simultaneous insertion of the movable contact terminal and the lock into the stationary contact terminal, and means for disengagement at the end of the connection phase for ensuring, by inertial effect, the locking of the connector.

According to other characteristics:

- The means for engagement consist of a lug for the movable contact terminal and a hole for the lock;
- The lug comprises an outside surface in the shape of an obtuse dihedron consisting of two planar faces that respectively work with, during the insertion motion, a fourth shoulder of the stationary contact terminal and the hole to ensure a transverse motion of the movable contact terminal and the disengagement of the lock and the movable contact terminal;
- The stationary contact terminal consists of a base that has stationary electric contacts and an essentially tubular upper portion whose walls have edges that are inclined toward the inside to guide the insertion of the movable contact terminal;
- The rear and front walls of the stationary contact terminal respectively comprise a first shoulder and a second shoulder to ensure the guiding of the lock in the connection phase;
- The front wall of the stationary contact terminal comprises a third shoulder that works with a first hollow of the movable contact terminal to ensure the transverse motion of the movable contact terminal;
- The base of the stationary contact terminal has a pin working with a second hollow of the movable contact terminal to ensure the transverse motion of the movable contact terminal;
- The movable contact terminal has a groove in which a shunt for the electric contacts is placed;

- The lock has a tab that can detach the shunt of the electric contacts in the locking phase of the connector.

The invention also has as its object a process for connection and locking of an electric connector that comprises a stationary contact terminal, a movable contact terminal, and a lock, characterized by the following stages:

- To engage the lock and the movable contact terminal to form a sub-assembly,
- To insert said sub-assembly into the stationary contact terminal by an axial motion,
- To superimpose, by mechanical means, a transverse motion on the axial motion of insertion so as to clean the connection surfaces,
- To trigger the disengagement of the lock and the movable contact terminal by this transverse motion to ensure, by inertial effect, on the one hand the end of the connection of the movable contact terminal to the stationary contact terminal, and on the other hand the continuation by the lock of the axial motion,
- To lock the connector by ratcheting the lock onto the stationary contact terminal.

BRIEF DESCRIPTION OF THE DRAWINGS

Other characteristics will emerge from the following description given with reference to the accompanying drawings of an embodiment of a connector according to the invention, in which:

FIG. 1 is a top view of the connector;

FIG. 2 is a cutaway view along the line AA of FIG. 1, representing the entire connector in locked position;

DETAILED DESCRIPTION OF THE PREFERRED EMBODIMENTS

Figure 12:
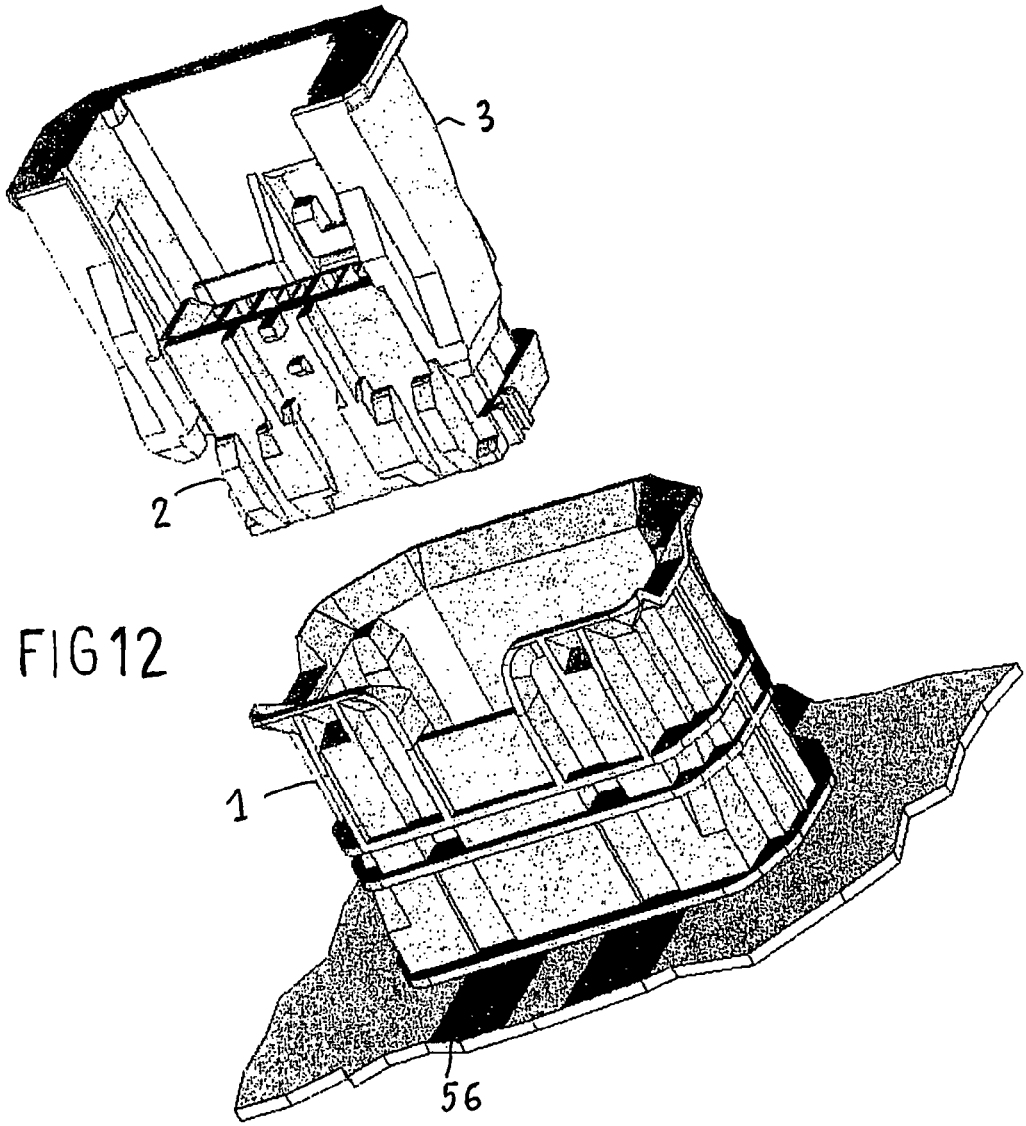
FIG. 12 is a general outline of the rear, before connection, of an embodiment of a connector according to the invention for the connection of a bundle of conductors to a printed circuit.
Figure 14:
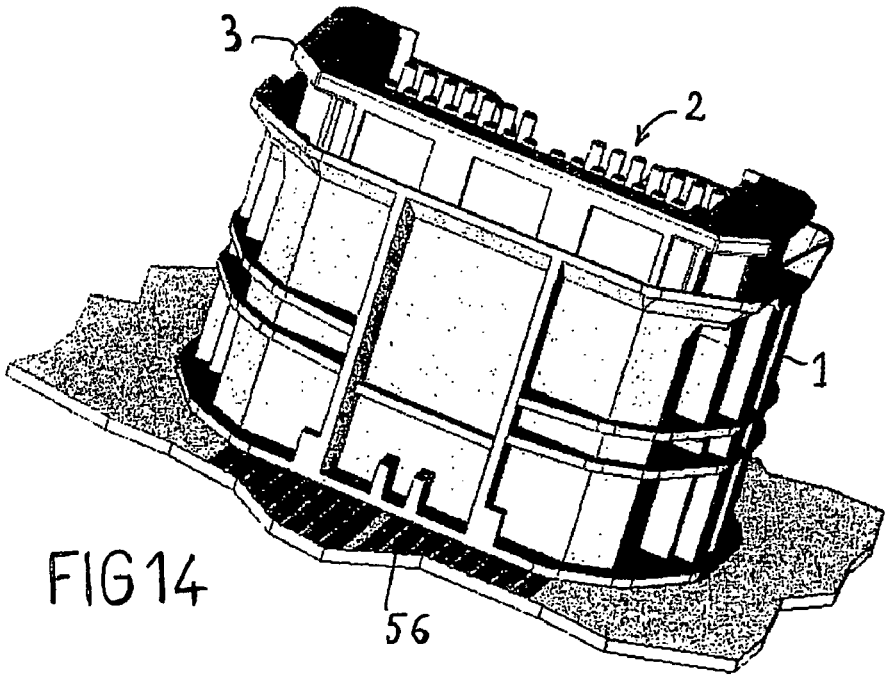

FIG. 14 is a view of the connector of FIG. 12 at the end of the connection.

In these drawings, the connector according to the invention essentially comprises three mechanical parts, in addition to snap-on electric contacts and an optional shunt designed to keep the electric contacts of the movable portion of the connector at the same potential. These three mechanical parts are a stationary contact terminal 1, a movable contact terminal 2 and a lock 3.

Figure 3:
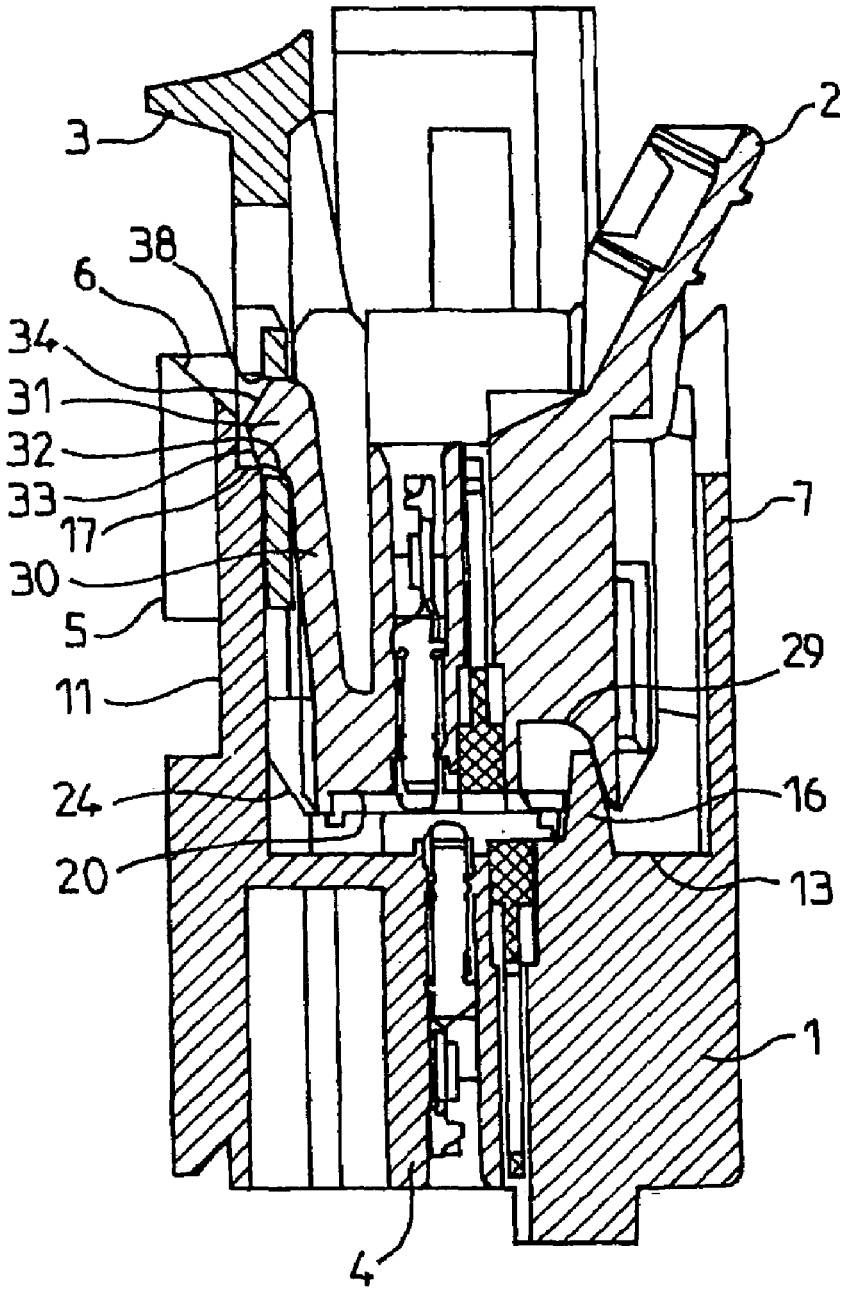
FIG. 3 is a cutaway view along line BB of FIG. 1, representing the entire connector at the beginning of the connection phase.

In the embodiment shown in FIG. 3, stationary contact terminal 1 is a hollow body, essentially parallelepipedic in shape, with a base 4 that has the stationary electric contacts, and with an upper portion 5, essentially tubular, for receiving the movable contact terminal 2 and the lock 3. The opening of the upper portion 5 of the stationary contact terminal 1 comprises edges 6 that are inclined toward the inside to constitute ramps for guiding movable contact terminal 2.

On the rear wall 7 of the stationary contact terminal 1, the edges 6 constitute stops for holding the movable contact terminal 2 at the end of the connection phase.

On the lateral walls 8, 9 of the stationary contact terminal 1, the edges 6 constitute stops for holding the lock 3 at the end of the locking phase.

In the vicinity of the lateral walls 8, 9 (section line DD, FIG. 5), the upper portion 5 of the stationary contact terminal 1 presents: on the rear wall 7, a section with a first shoulder 10, whereby the wall essentially has the thickness of the inclined edge 6 above the shoulder 10 and a smaller thickness below; and on the front wall 11, a section with a second shoulder 12, whereby the wall has essentially the thickness of the inclined edge 6 above the shoulder 12 and a larger thickness below. The second shoulder 12 of the front wall 11 is located between the inclined edge 6 and the plane 13 of stationary contacts, toward the upper third, whereas the first shoulder 10 of the rear wall 7 is located toward the lower third of the space encompassed between the inclined edge 6 and the plane 13 of stationary contacts.

In the plane of the section line CC (FIG. 4), the rear wall 7 of the stationary contact terminal 1 is uniformly thin and set back relative to the inclined edge 6, thus providing a catch 14 for locking the movable contact terminal 2 under the inclined edge 6. The front wall 11 has, above the plane 13 of stationary contacts, a third shoulder 15, whereby the wall 11 is thin above the shoulder 15 and thicker below.

In the plane of the section line BB (FIG. 3), the stationary contact terminal 1 has, in relief above the plane 13 of the stationary contacts, a pin 16 behind the stationary contacts, and on the front wall 11, just below the inclined edge 6, a fourth shoulder 17, whereby the wall is thicker below the shoulder 17.

Stationary electric contacts 18, perpendicular to the plane 13 of the stationary contacts, are placed in the base 4. These contacts 18 are preferably snap-on, i.e., their contact studs extend above the plane 13 and are able to move elastically when supported by the movable contacts.

The movable contact terminal 2 has a general parallelepipedic shape. It comprises movable electric contacts 19 that are preferably snap-on and that are able to rest on the stationary contacts 18. These contacts 19 are housed in the central portion of the movable contact terminal 2 and extend below the lower face 20 of the movable contact terminal 2.

Figure 4:
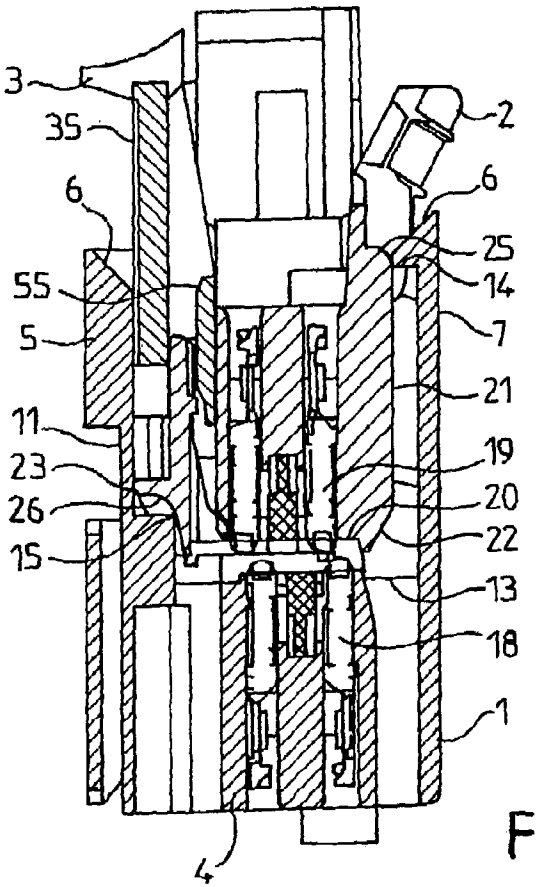
FIG. 4 is a cutaway view along line CC of FIG. 1 representing the entire connector at the beginning of the connection phase.

The movable contact terminal 2 is designed to be introduced into the upper portion 5 of the stationary contact terminal 1 and to be moved toward the rear wall 7 after engaging with the locking catch 14 (FIG. 4). For this purpose, the rear wall 21 has in its lower portion a first beveled edge 22 that is designed, in cooperation with the inclined edge 6 of the rear wall 7 of the stationary contact terminal 1, to facilitate the centering of the movable contact terminal 2 and its introduction into the stationary contact terminal 1. Likewise, the front wall 23 of the movable contact terminal 2 has in its lower portion a second beveled edge 24 (FIG. 3) that is designed to work with the inclined edge 6 of the front wall 11 of the stationary contact terminal 1.

In its upper portion (FIG. 4), the rear wall 21 of the movable contact terminal 2 has a fifth shoulder 25 that is rounded and designed to work with the locking catch 14 of the stationary contact terminal 1.

In the plane of the section line CC (FIG. 4), the front wall 23 of the movable contact terminal 2 has a first hollow 26, with a curved section, designed to work with the third shoulder 15 of the stationary contact terminal 1 to ensure the motion toward the rear of the movable contact terminal 2.

Figure 6:
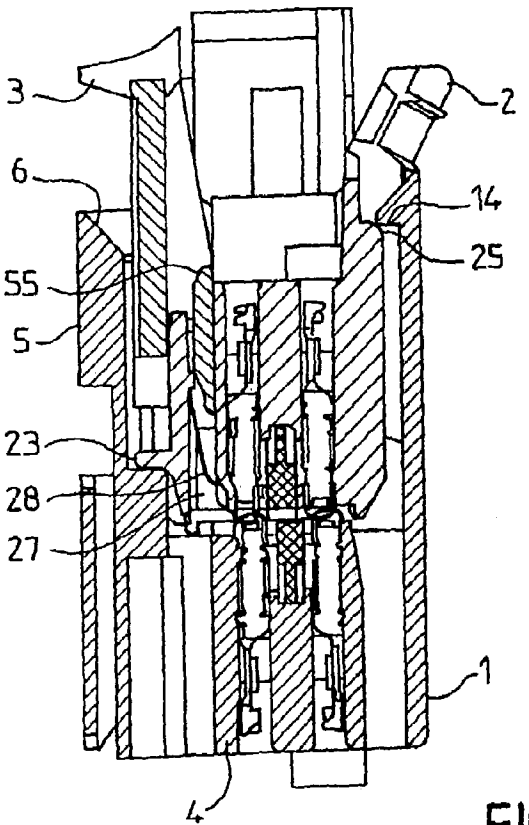

A shunt 28 in the form of an elastically deformable blade, whose bent lower edge is in contact with the movable electric contacts 19 when the connector is not locked, is placed in a groove 27 of the movable contact terminal 2 (FIG. 6).

In the median portion, corresponding to the section line BB (FIG. 3), the movable contact terminal 2 has, in its lower portion, a second hollow 29 with a curved section, designed to work with the pin 16 of the stationary contact terminal 1 to ensure the motion toward the rear of the movable contact terminal 2.

In its front portion, the movable contact terminal 2 has an arm 30 that is inclined outward relative to the longitudinal axis of the connector, whereby this arm 30 is integral with the lower portion of the movable contact terminal 2, near the lower face 20. At its free end located toward the top, the arm 30 has a lug 31 extending outward by means of a curved section 32.

This lug 31 has, facing outward, a surface in the shape of an obtuse dihedron, consisting of two planar faces 33 and 34.

The lower face 33 is able to work with the fourth shoulder 17 of the stationary contact terminal 1, and the upper face 34 is able to work with the lock 3 to accompany the motion toward the rear of the movable contact terminal 2.

The lock 3 comes as one part that consists of three flaps: a central flap 35 and two lateral flaps 36 and 37.

The central flap 35 is inserted between the front wall 11 of the stationary contact terminal 1 and the movable contact terminal 2. In its median zone (FIG. 3), it has a hole 38 that can receive the lug 31 before insertion of the movable contact terminal 2 into the stationary contact terminal 1.

The lateral flaps 36 and 37 are inserted between the lateral walls 8 and 9, respectively, of the stationary contact terminal 1 and the movable contact terminal 2 (FIG. 2). In their lower portion, they have a beveled edge, respectively 39 and 40, to facilitate the centering of the movable contact terminal 2 during its insertion into the stationary contact terminal 1. In their upper portion, they consist of two walls that are separated by an open space at the top so as to allow an elastic deformation of the outside walls 41 and 42 respectively. The outside walls 41 and 42 each have an outside catch 43 and 44 respectively that is able to work with the inclined edge 6 of the corresponding lateral wall 8, 9 respectively, of the stationary contact terminal 1 to ensure the locking in the connection position of the connector. On their lower face, the lateral flaps 36 and 37 each have a catch (FIG. 2) that works with a corresponding catch that is placed on the outside face of the movable contact terminal 2 to ensure the insertion of the mobile contact terminal into the stationary contact terminal 1.

The lateral flaps 36, 37 have a polygonal contour to be able to be inserted between the front wall 11 and the rear wall 7 of the stationary contact terminal 1, which each comprise a shoulder, 12 and 10 respectively, and a variation of thickness at their respective shoulder.

Figure 5:
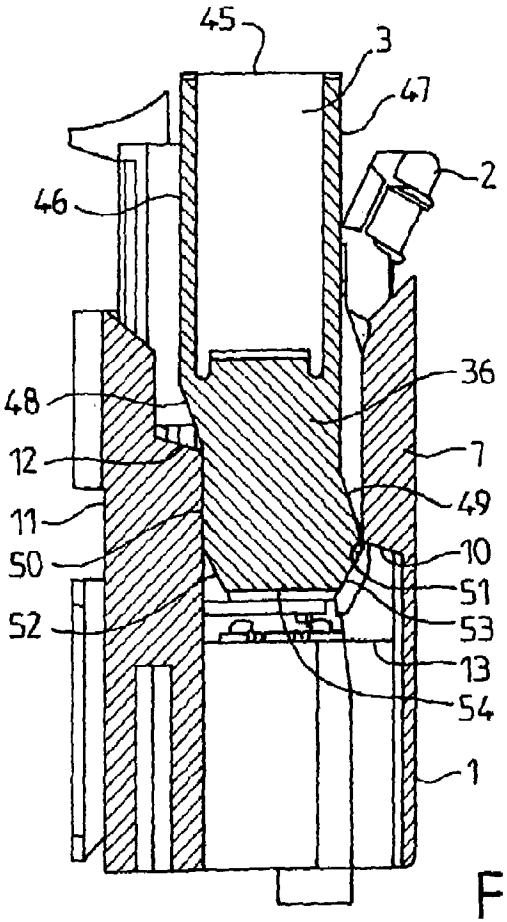
FIG. 5 is a cutaway view along line DD of FIG. 1 representing the lock at the beginning of the connection phase.

Thus, the flap 36 has an upper portion that consists of a rectangular trapezium, with an upper edge 45 that is horizontal to FIG. 5, a vertical front edge 46, and a rear edge 47 that is vertical and longer than the front edge 46. The front edge 46 and the rear edge 47 each extend toward the bottom via a segment 48, 49 respectively, oblique toward the rear. The two segments 48 and 49 are approximately equal and are parallel to one another. The segment 48 extends via a straight segment 50, parallel to the front edge 46, which extends up to the height of the edge 51 that limits the segment 49. Then, two oblique segments 52 and 53 converge toward the horizontal lower edge 54 of the flap 36.

Figure 11:
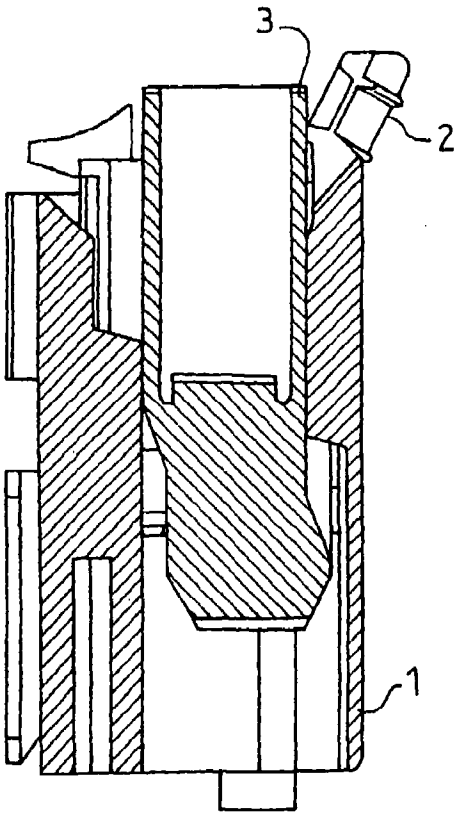
FIGS. 10 and 11 are respectively analogous to FIGS. 8 and 9 after deshunting.

The shortest distance between the front wall 11 and the rear wall 7 of the stationary contact terminal 1 in the plane of the section line DD is equal to the length of the upper edge 45 of the flap 36 after the connector is locked (FIG. 11). It is equal to the distance between the stop 51 and the straight segment 50 at the beginning of the connection (FIG. 5). During the connection phase, the two oblique segments toward the rear, 48 and 49, follow the stops of the shoulders 12 and 10 respectively to ensure the motion toward the rear of the lock 3 and, consequently, of the movable contact terminal 2.

Figure 10:
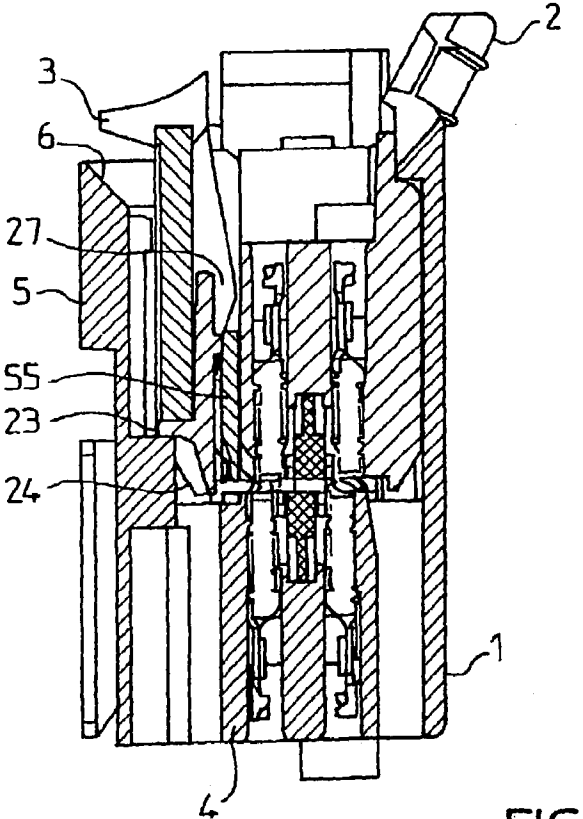

To the right of the section line CC, the lock 3 has a tab 55 that is designed, in the locking phase of the connector (FIG. 10), to detach the shunt 28 of the electric contacts of the movable contact terminal 2.

The operation of the connector is analyzed in the following manner.

Whereby the stationary contact terminal I is in place, the sub-assembly that consists of the movable contact terminal 2 and the lock 3 is presented and brought close to, for example manually, the upper opening of the stationary contact terminal 1. The beveled edges 22, 24, 39, 40 work with the inclined edges 6 to guide the insertion of the movable contact terminal 2 into the stationary contact terminal 1. Then, the oblique segment 52 slides over the second shoulder 12 to guide the flap 36 between the front walls 11 and rear walls 7 until the stop 51 reaches the rear wall 7.

In the beginning connection phase (FIGS. 4 and 5), the flap 36 is guided by the support of the straight segment 50 against the front wall 11 below the second shoulder 12 and by the support of the stop 51 on the rear wall 7. Furthermore, the rear wall 21 of the movable contact terminal 2 slides over the inclined edge 6, and the lock 3 slides against the front wall of the upper portion 5 of the stationary contact terminal 1.

Figure 7:
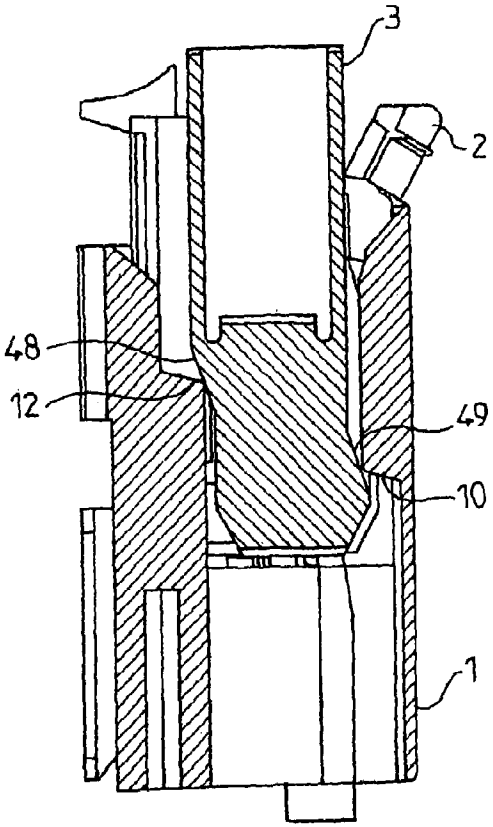
FIGS. 6 and 7 are respectively analogous to FIGS. 4 and 5 during the connection phase.

In the connection phase (FIGS. 6 and 7), the oblique segments 48 and 49 slide respectively over the stops of shoulders 12 and 10. The result is a motion toward the rear of the movable contact terminal 2, which is combined with the resulting downward motion of the pressure, manual for example, exerted on the lock 3. Simultaneously, the first hollow 26 works with the third shoulder 15 (FIG. 6) and the second hollow 29 works with the pin 16 (FIG. 3) to force the movable contact terminal 2 to move toward the rear.

This motion toward the rear, whereas the electric contacts are in contact, ensures a cleaning of the connection surfaces. The continuation of the pressure on the lock 3 and the correlative motion of the movable contact terminal 2 toward the rear ensure (FIG. 3) that the lug 31 is retracted little by little and ceases being held by the fourth shoulder 17. Under the pressure transmitted by the lock 3, and as the reaction exerted by the fourth shoulder 17 disappears, the movable contact terminal 2 descends and retracts. The lower planar face 33 of the lug 31 then slides over the fourth shoulder 17 and accentuates the removal of the movable contact terminal 2.

This removal causes the lug 31 to retract into the hole 38 of the lock 3. The upper planar face 34 begins to emerge from the hole 38, which disengages the lock 3 from the movable contact terminal 2. The lock 3, continuing its downward motion, slides over the upper planar face 34 and pushes the movable contact terminal 2 back toward the rear. The disengagement of the lock 3 and the movable contact terminal 2 brings about an inertial effect and ensures the completion of the connection operation until the connector is locked. The movable contact terminal 2 completes its downward, retracting motion toward the rear wall 7 of the stationary contact terminal 1; thanks to its fifth rounded shoulder 25, the rear portion of the movable contact terminal 2 is inserted under the locking catch 14.

Figure 9:
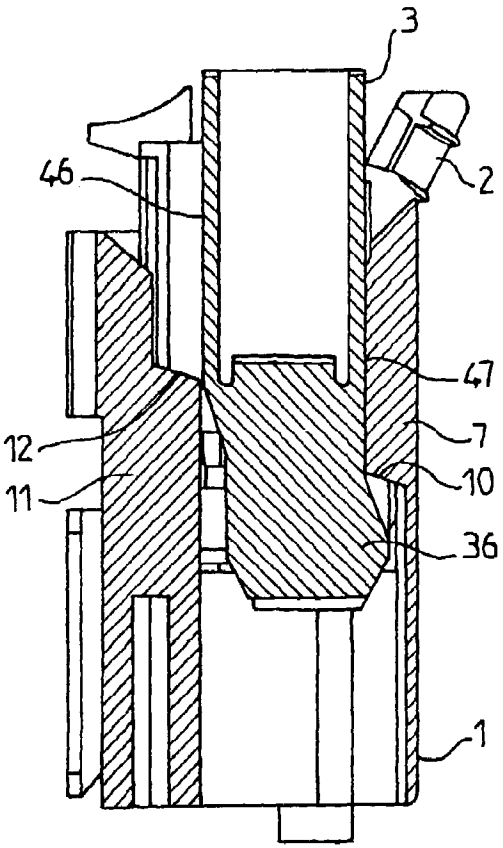
FIGS. 8 and 9 are respectively analogous to FIGS. 6 and 7 at the end of the connection phase.
Figure 8:
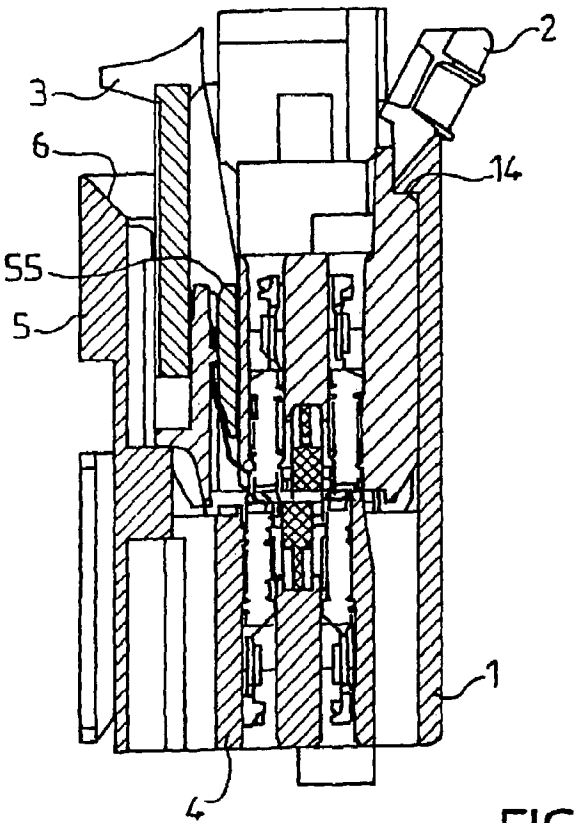

In the end-of-connection phase (FIGS. 8 and 9), the motions of the movable contact terminal 2 are ended, and the locking catch 14 ensures the holding of the movable contact terminal 2 and the pressure on the electric contacts. This arrangement makes it possible to ensure that the connection is maintained and the number of parts in the reassembly of the sides is reduced. The front edge 46 of the flap 36 is supported on the front wall 11 of the stationary contact terminal 1 below the second shoulder 12, and the rear edge 47 of the flap 36 is supported on the rear wall 7 of the stationary contact terminal 1 above the first shoulder 10.

In the locking phase (FIGS. 10, 11 and 2) and always by inertial effect, the downward motion of the sole lock 3 continues until the catches 43 and 44 of the outside walls 41 and 42 of the lateral flaps 36 and 37 respectively engage with the inclined edges 6 of the stationary contact terminal 1 and come to be locked there. During this last downward motion, the lock 3 entrains the tab 55 that lifts the shunt 28 and ensures the shunt 28 is detached from the electric contacts.

The unlocking of the connector is carried out by application of a manual pressure to the outside walls 41, 42 of the lateral flaps 36, 37 for drawing them close to one another and for releasing the catches 43, 44 of the inclined edges 6. The lock 3 is then drawn off manually. During its extraction motion, on the one hand, it releases the shunt 28 that is reinstalled on the electric contacts, and on the other hand it reengages with the lug 31 and brings about the extraction of the movable contact terminal 2.

Thus, the initial engagement of the lock 3 and the movable contact terminal 2 ensures the correct connection of the movable contact terminal 2 in the stationary contact terminal 1, and then, during the same motion, which is continued by inertial effect after disengagement from the lock 3 and the movable contact terminal 2, the locking in the connector position.

The connector according to the invention was described in a particular embodiment that is in no way limiting, whereby the technical equivalents enter into the scope of this invention.

Figure 13:
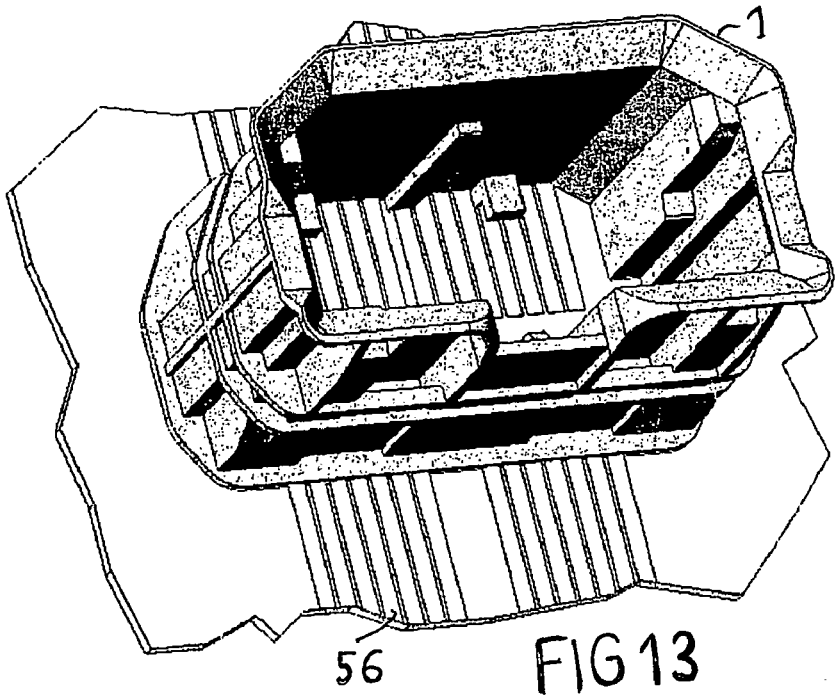
FIG. 13 is a perspective view of the stationary contact terminal of FIG. 12, in position on the printed circuit.

In the embodiment of the FIGS. 12 to 14, the stationary contact terminal 1 has a limited height. Actually, the plane 13 of the stationary contacts is the plane of a printed circuit 56, and the body of the stationary contact terminal 1 is attached to the support of the printed circuit 56.

The downward motion of the lock 3 cannot extend below the plane of the printed circuit. So that the locking takes place under the same conditions as for the connector of FIGS. 1 to 11, the structure elements of the stationary contact terminal 1 that work with the lock 3 are offset upward. Thus, the locking kinematics is the same as in the example that is described in FIGS. 1 to 11.

The invention also has as its object a process for connection and locking of an electric connector that comprises a stationary contact terminal (1), a movable contact terminal (2) and a lock (3), characterized by the following stages:

- To engage the lock 3 and the movable contact terminal 2 to form a sub-assembly,
- To insert said sub-assembly into the stationary contact terminal 1 via an axial motion,
- To superimpose, by mechanical means, a transverse motion on the axial motion of insertion so as to clean the connection surfaces,
- To trigger the disengagement of the lock 3 and the movable contact terminal 2 by this transverse motion to ensure, by inertial effect, on the one hand the end of the connection of the movable contact terminal 2 on the stationary contact terminal 1, and on the other hand the continuation by the lock of the axial motion, To lock the connector by ratcheting the lock onto the stationary contact terminal 1.

The invention claimed is:

1. A self-centering, inertial-locking connector, comprising:

a stationary contact terminal;

a movable contact terminal; and a lock, the movable contact terminal and the lock comprise means for engagement for ensuring the simultaneous insertion of the movable contact terminal and the lock into the stationary contact terminal, and means for disengagement at an end of a connection phase for ensuring, by inertial effect, locking of the connector, wherein the means for engagement comprise a lug of the movable contact terminal and a hole in the lock, and wherein the lug comprises an outside surface in the shape of an obtuse dihedron, consisting of two planar faces that respectively engage, during insertion of the movable contact into the stationary contact, a first shoulder of the stationary contact terminal and the hole, to ensure a transverse motion of the movable contact terminal and the disengagement of the lock and the movable contact terminal.

2. The connector according to claim 1, wherein the stationary contact terminal comprises a base and an essentially tubular upper portion, of said upper portion having edges that are inclined toward an inside of the stationary contact terminal to guide insertion of the movable contact terminal.

3. The connector according to claim 2, wherein a rear one of said walls and a front one of said walls respectively comprise a second shoulder and a third shoulder to ensure the guiding of the lock into the connection phase.

4. The connector according to claim 2, wherein a front one of said walls comprises a fourth shoulder that works with a first hollow of the movable contact terminal to ensure the transverse motion of the movable contact terminal.

5. The connector according to claim 2, wherein the base of the stationary contact terminal has a pin that works with a second hollow of the movable contact terminal to ensure the transverse motion of the movable contact terminal.

6. The connector according to claim 1, wherein the movable contact terminal has a groove in which a shunt for electric contacts of the movable contact terminal is placed.

7. The connector according to claim 6, wherein the lock has a tab that detaches the shunt of the electric contacts during the locking of the connector.

* * * * *